US005674120A

United States Patent [19]

Legatt et al.

[11] Patent Number: 5,674,120

[45] Date of Patent: Oct. 7, 1997

[54] FLOOR POLISHING MACHINE

[75] Inventors: Donald J. Legatt, St. Michael; David Wood, Maple Plain, both of Minn.

[73] Assignee: Advance Machine Company, Plymouth, Minn.

[21] Appl. No.: 723,785

[22] Filed: Sep. 30, 1996

[51] Int. Cl.[6] ..... B24B 27/08

[52] U.S. Cl. ..... 451/350; 451/353; 15/49.1; 15/98

[58] Field of Search ..... 451/353, 350; 15/49.1, 50.1, 410, 98

[56] References Cited

U.S. PATENT DOCUMENTS

| | | |
|---|---|---|
| 858,538 | 7/1907 | Remington . |
| 1,650,690 | 11/1927 | Cavicchi . |
| 1,875,138 | 8/1932 | Pond et al. . |
| 1,918,713 | 7/1933 | Ponselle . |
| 2,039,861 | 5/1936 | Watts . |
| 2,142,697 | 1/1939 | Myers . |
| 2,693,001 | 11/1954 | Vance . |
| 2,842,788 | 7/1958 | Rench et al. . |
| 3,013,287 | 12/1961 | Descarries . |
| 3,100,903 | 8/1963 | Doyle, Sr. . |
| 3,154,802 | 11/1964 | Hanschitz et al. . |
| 3,155,996 | 11/1964 | Berthelot et al. . |
| 3,303,524 | 2/1967 | Schneider . |
| 4,075,907 | 2/1978 | Petrzelka . |
| 4,115,890 | 9/1978 | Burgoon . |
| 4,277,035 | 7/1981 | Gaski . |
| 4,358,868 | 11/1982 | Cook, Jr. . |
| 4,658,459 | 4/1987 | Wood . |
| 4,707,169 | 11/1987 | Wareham et al. . |
| 4,809,393 | 3/1989 | Goodrich et al. . |
| 5,259,085 | 11/1993 | Marafante et al. ..... 15/98 |
| 5,327,610 | 7/1994 | Smith ..... 15/49.1 |

*Primary Examiner*—Robert A. Rose
*Assistant Examiner*—George Nguyen
*Attorney, Agent, or Firm*—Peterson, Wicks, Nemer & Kamrath, P.A.

[57] ABSTRACT

A floor polishing machine (10) according to the preferred form of the teachings of the present invention includes a body portion (12) having a platform (20), and a handle (16) pivotally mounted to the platform (20). First and second sets of wheels (68, 70) are provided adjacent the rear of the platform (20) and on opposite sides of the handle pivot (50). For coupling the handle (16) and the platform (20) together, a gas spring (53) is provided having a first end pivotally connected to the platform (20) and having a second end pivotally connected to the handle (16). The gas spring (53) urges the platform to pivot about the first set of wheels (68) downwardly in the rear and upwardly in the front. The motor (24) for rotating the polishing member (14) is pivotally mounted to the platform (20) by ears (23) so that the polishing member (14) can flushly abut the floor surface. The handle (16) is latched in an upright transport position by a pin (59) received in the first leg (85) of an L-shaped slot (81) formed in a latch (74) pivotably mounted to the platform (20) and is allowed to pivot in operating positions when the pin (59) is received in the second leg (83) of the L-shaped slot (81). The latch (74) includes a cord hook (77), with the spacing between the handgrip (89) of the handle (16) and the cord hook (77) being less in the operating positions than in the transport position so that an electric cord (87) wrapped around the handgrip (89) and the cord hook (77) can be removed without unwrapping when the handle (16) is moved from its transport position to an operating position.

18 Claims, 3 Drawing Sheets

FLOOR POLISHING MACHINE

BACKGROUND

The present invention relates generally to floor polishing machines, and specifically to improved floor polishing machines having improved efficiences and which are easier to operate and assemble.

As set forth in U.S. Pat. No. 4,658,459, it is desirable to control the amount of weight the floor polishing machine places upon the pad or other polishing member during operation of the floor polishing machine. This weight control is important in controlling the polishing pressure the pad or polishing member places on the floor surface and in controlling the amperage draw of the motor of the floor polishing machine. Prior to U.S. Pat. No. 4,658,459, this weight control was generally accomplished by having a fixed handle on the floor polishing machine, where the operator controlled the pad pressure by lifting or pushing on the handle. The problem with this type of operator involvement was the pad pressure was variable because different operators place different pressures on the polishing member of the floor polishing machine and because of operator fatigue. The floor polishing machine of U.S. Pat. No. 4,658,459 maintains even pad pressure automatically and not dependent on operator involvement. However, due to the requirement that the torsion springs utilized therein had to be preloaded, the floor polishing machines of U.S. Pat. No. 4,658,459 generally could not be sold partially assembled due to the risk of components flying apart during assembly by unskilled persons and/or by persons without the proper assembly tools and jigs. Thus, a need continues to exist for a floor polishing machine which maintains even pad pressure automatically and not dependent on operator involvement and also is easier to assemble by unskilled persons without any special tools or jigs and which otherwise overcomes the deficiencies of prior floor polishing machines.

Additionally, the advantages of the ability of the floor polishing member to flushly abut and follow the floor surface were recognized in at least U.S. Pat. No. 4,731,956. However, the construction disclosed in U.S. Pat. No. 4,731,956 relates to a battery powered unit where wheels support a frame which carries the floor polishing member. Thus, a need exists for a floor polishing machine of the type where the platform which carries the floor polishing member is directly movably supported by wheels and which is pivotable relative to the floor surface about the wheels such as shown in U.S. Pat. No. 4,658,459 and having the ability for the floor polishing member to flushly abut the floor surface around its entire circumference and to follow the floor surface.

Further, floor polishing machines and like electrical appliances include a long electrical cord having a free end which can be plugged into a convenient electrical outlet. During transport and storage, it is typical to wrap the cord around two cord hooks or a cord hook and a hand grip. Thus, when it is desired to operate the appliance, it is necessary to unwrap the cord loop by loop from the appliance which is a time consuming process. Thus, a need exists for methods allowing the wrapped cord to be quickly released from the appliance when it is desired to operate the appliance. In further aspects, it would be advantageous for the cord quick release mechanism to perform other functions such as latching the handle in a transport position relative to a body portion.

SUMMARY

These needs and other problems in the field of floor polishing machines and other electrical appliances are solved, in the preferred form, by providing a latch pivotably mounted to a body portion and operatively connected to a handle also pivotably mounted to the body portion, with the latch and handle each including cord hooks which have decreasing spacing as the handle and the latch are pivoted from a transport position to an operating position so that an electric cord wrapped around the cord hooks can be removed as a unit without unwrapping. In preferred aspects of the present invention, the latch also latches the handle in the transport position.

In other aspects of the present invention, a polishing member is pivotably mounted to a platform about an axis which is spaced from and parallel to the axis of the wheels which movably support the platform on the floor surface and about which the platform can be pivoted relative to the floor surface. Thus, the polishing member is able to follow the floor surface and flushly abut the floor surface around its entire circumference.

In still other aspects of the present invention, a pressurized gas spring is provided for urging a polishing member away from the floor surface when the polishing member is not being rotated while allowing the polishing member to be drawn to the floor with a controlled force when a partial vacuum is formed under the polishing member when it is rotated. In the most preferred form, the ends of the gas spring are pivotably connected between a platform and a handle, with the platform being movably supported by wheels on the floor surface and being pivotal relative to the floor surface about the wheel axis, with the gas spring biasing the rear of the platform in a downward direction and the front of the platform in an upward direction.

Thus, it is an object of the present invention to provide a novel machine for polishing floor surfaces.

It is further an object of the present invention to provide such a novel floor polishing machine utilizing a gas spring for placing even polishing force on the floor surface by the polishing member regardless of the pivotal position of the handle with respect to the platform.

It is further an object of the present invention to provide such a novel floor polishing machine utilizing a gas spring for placing even polishing force on the floor surface by the polishing member regardless of the unevenness of the floor surface.

It is further an object of the present invention to provide such a novel floor polishing machine utilizing a gas spring for automatically maintaining even polishing pressure.

It is further an object of the present invention to provide such a novel floor polishing machine utilizing a gas spring for maintaining even floor polishing pressure without being dependent on operator involvement.

It is further an object of the present invention to provide such a novel floor polishing machine utilizing a gas spring so that polishing pressure is not variable due to operation by different operators.

It is further an object of the present invention to provide such a novel floor polishing machine utilizing a gas spring so that polishing pressure is not variable due to operator fatigue.

It is further an object of the present invention to provide such a novel floor polishing machine utilizing a gas spring which urges the polishing member upward while utilizing suction effect to control relatively even polishing pressure.

It is further an object of the present invention to provide such a novel floor polishing machine allowing the wrapped electric cord to be removed as a unit and without unwrapping from cord hooks.

It is further an object of the present invention to provide such a novel floor polishing machine having a cord quick release mechanism which also is utilized to latch the handle in a transport position.

It is further an object of the present invention to provide such a novel floor polishing machine where the floor polishing member flushly engages the floor surface when the platform is movably supported and pivotal about wheels rotatably mounted to the platform.

It is further an object of the present invention to provide such a novel floor polishing machine where the floor polishing member follows the floor surface regardless of the unevenness of the floor surface.

It is further an object of the present invention to provide such a novel floor polishing machine which has improved polishing efficiencies.

It is further an object of the present invention to provide such a novel floor polishing machine which is easier to operate.

It is further an object of the present invention to provide such a novel floor polishing machine which is easier to assemble.

It is further an object of the present invention to provide such a novel floor polishing machine which can be assembled in its final operating form without any special tools or jigs.

It is further an object of the present invention to provide such a novel floor polishing machine not having the risk of components flying apart during assembly or servicing.

It is further an object of the present invention to provide such a novel floor polishing machine providing even pressure and a full polishing pattern regardless of pad thickness and without wheel adjustment.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
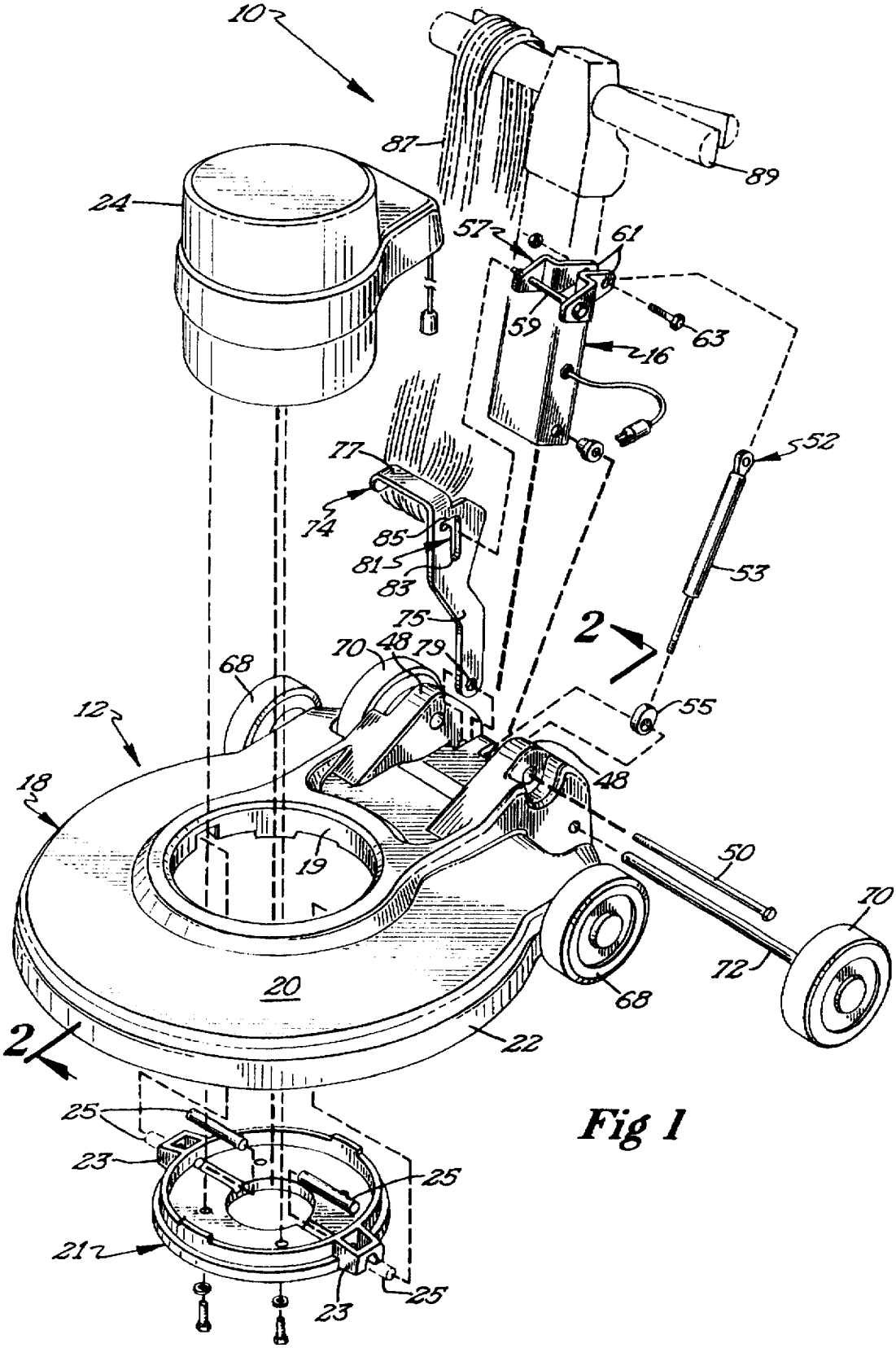
FIG. 1 shows an exploded perspective view of a floor polishing machine according to the preferred teachings of the present invention.
Figure 2:
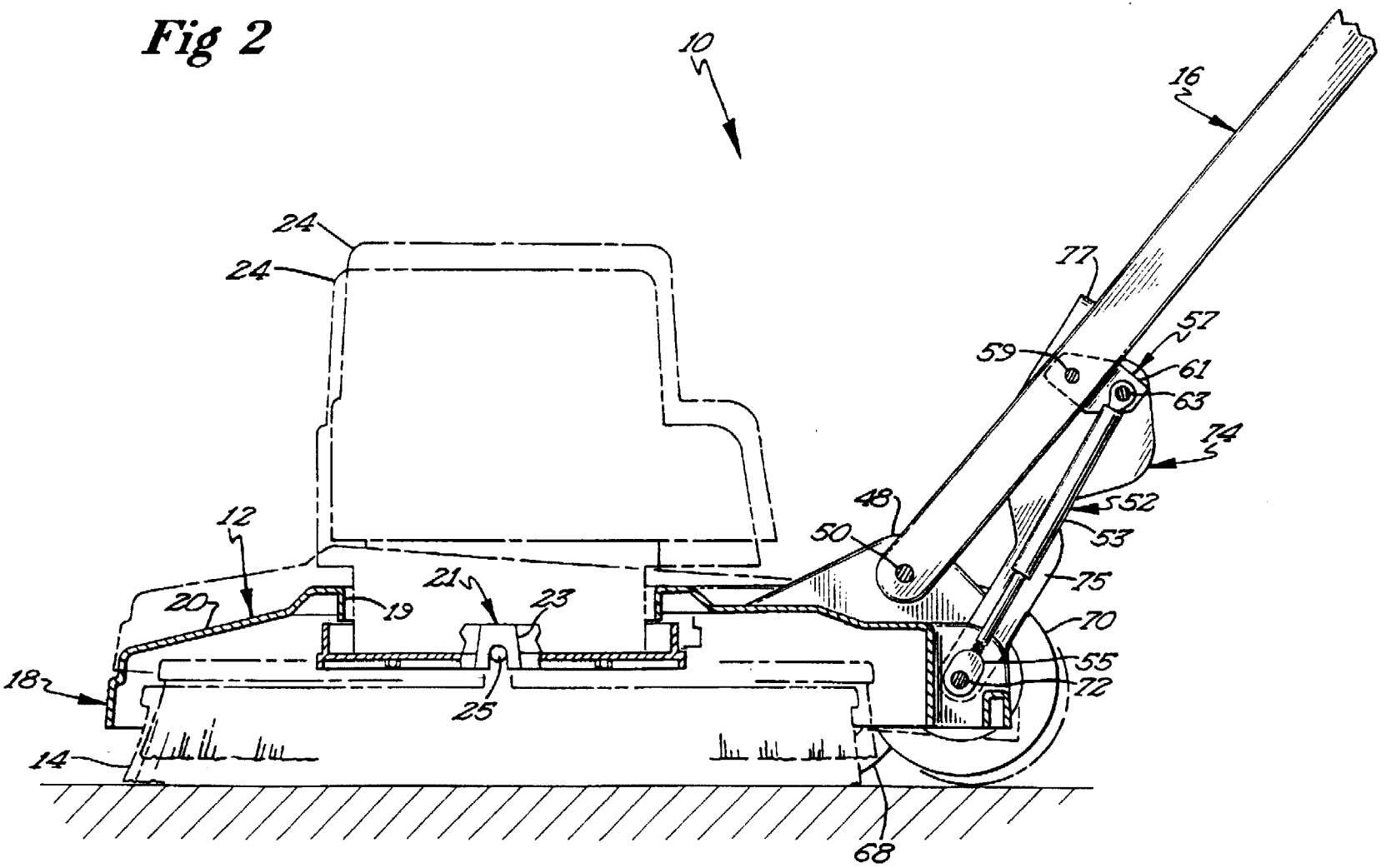
FIG. 2 show, cross sectional view of the floor polishing machine of FIG. 1 according to section line 2—2 of FIG. 1.
Figure 3:
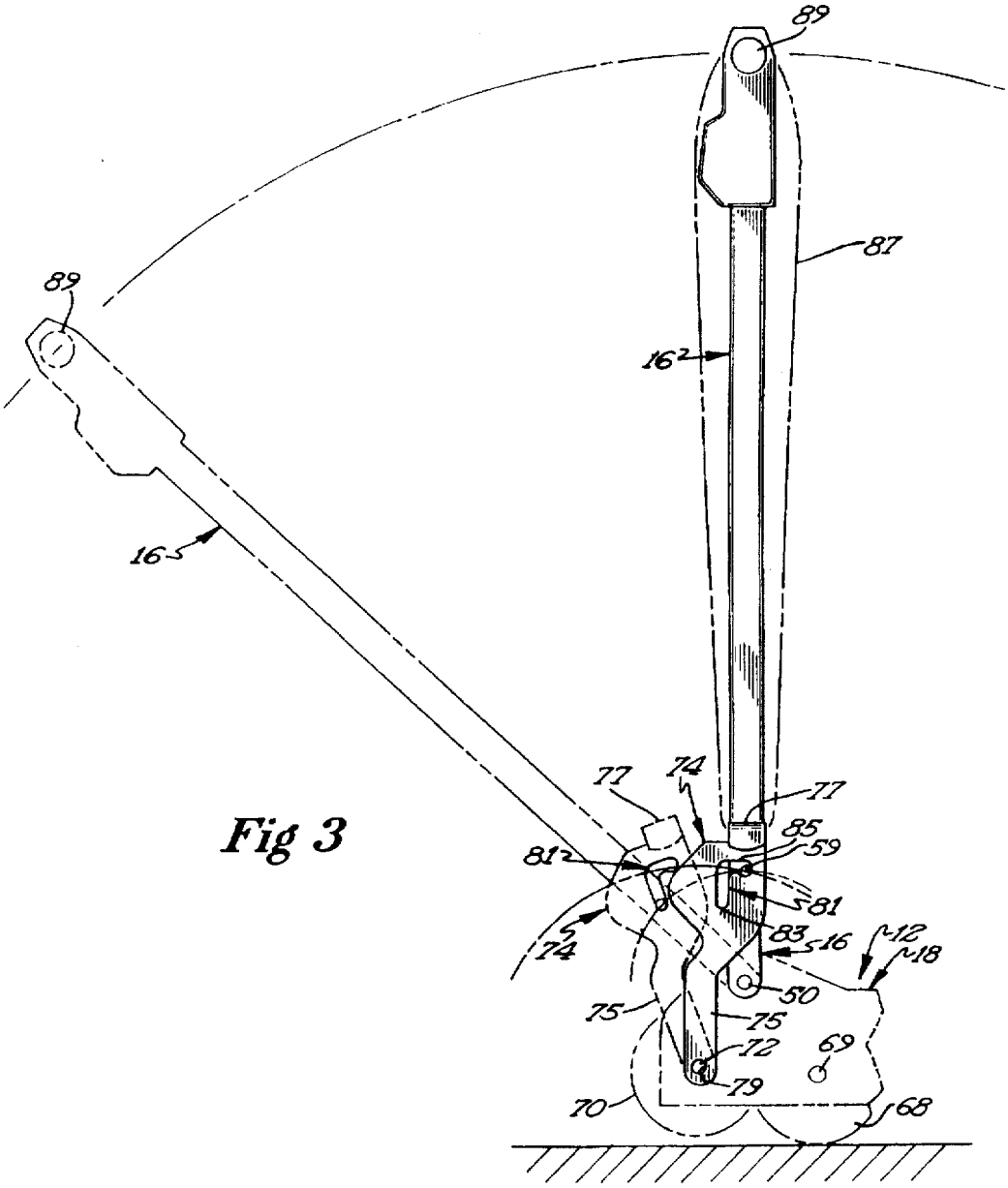
FIG. 3 shows a diagrammatic view of the floor polishing machine of FIG. 1 showing that the distance between the cord hooks decreases as the handle is pivoted from its transport or storage position to its release or operative position.

All figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "front", "back", "rear", "height", "width", "length", "end", "side", "horizontal", "vertical", and similar terms are used herein, it should be understood that these terms have reference only to the structure shown in the drawings as it would appear to a person viewing the drawings and are utilized only to facilitate describing the illustrative embodiment.

DESCRIPTION

An electrical floor appliance according to the teachings of the present invention is shown in the drawings in the preferred form of a floor polishing machine and is generally designated 10. In the most preferred embodiment of the present invention, floor polishing machine 10 is an improvement of the type shown and described in U.S. Pat. No. 4,658,459. For purpose of explanation of the basic teachings of the present invention, the same numerals designate the same or similar parts in the present figures and the figures of U.S. Pat. No. 4,658,459. The description of the common numerals and floor polishing machine 10 may be found herein and in U.S. Pat. No. 4,658,459, which is hereby incorporated herein by reference.

Floor polishing machine 10 generally includes a body component or portion 12 adapted to be moved along a floor, a polishing member 14 such as a holder for a polishing pad, brush, or the like, and a transport component shown in the most preferred form as a handle 16 for guiding and controlling the body portion 12, with handle 16 being pivotally mounted to body portion 12 by a suitable pivot pin 50 and movable between operating positions and a transport position. In the most preferred form, handle 16 is of the type shown and disclosed in U.S. patent application Ser. No. 08/540,673, which is hereby incorporated herein by reference.

Body portion 12 according to the teachings of the present invention includes a first, substantially inverted cup-shaped, skirt housing 18 having a relatively flat platform 20 and a downwardly extending perimeter skirt 22. A motor 24 is mounted to platform 20 and in the preferred form is pivotally mounted to platform 20. Particularly, in the preferred form, platform 20 is annular shaped and includes a central opening 19. Housing 18 further includes an annular shaped motor mounting plate 21 having first and second ears 23 extending radially therefrom and on diametric opposite sides. Mounting plate 21 is pivotably mounted to platform 20 by suitable pivot pins 25 extending through ears 23 and suitably received in platform 20. Motor 24 is received on and suitably secured to mounting plate 21 and extends through opening 19 of platform 20. The pivot axis of motor 24 relative to platform 20 defined by pivot pins 25 is parallel to the pivot axis of handle 16 relative to housing 18 defined by pin 50. Polishing member 14 is operatively connected to the output shaft of motor 24 for rotation thereby and within skirt 22 and platform 20 of housing 18. It should be realized that due to its connection to motor 24 which is pivotable relative to platform 20, polishing member 14 is also pivotable relative to platform 20.

For pivotally mounting handle 16 to body portion 12, ears 48 are provided extending from platform 20 of housing 18 in the preferred form of the present invention. Handle 16 is located intermediate ears 48. For pivotally mounting handle 16 to body portion 12, elongated pivot pin 50 extends between ears 48 and through handle 16 spaced from its end.

Floor polishing machine 10 further includes according to the teachings of the present invention a first set of wheels 68 having a rotation axis located intermediate motor 24 and pivot pin 50 and extending at a level generally equal to but slightly lower than the level of skirt 22. In its most preferred form, wheels 68 are rotatably secured to skirt 22 of housing 18 of body portion 12 by an axle 69 extending through skirt 22 and having free ends extending outside of skirt 22 on opposite axial sides thereof.

According to the teachings of the present invention, floor polishing machine 10 further includes a second set of wheels 70 having a rotation axis defined by an axle 72 located on the opposite side of wheels 68 than motor 24 and particularly on the opposite side of pivot pin 50 than axle 69 and motor 24 and extending at a level slightly above the level of skirt 22. In its most preferred form, wheels 70 extend at a level in the range of one eighth to one fourth inch (0.3 to 0.6 cm) above the level of wheels 68. In the preferred construction of floor polishing machine 10, wheels 70 are rotatably secured by axle 72 to skirt 22 of housing 18 of body portion 12 and in particular the rotation axis of wheels 70 defined by axle 72 is generally parallel and adjacent to skirt 22 of housing 18 of body portion 12 such that wheels 70 extend beyond and rearward of skirt 22 of housing 18 of body portion 12.

A member 52 for urging the front of body portion 12 upward towards handle 16 is further provided according to the teachings of the present invention and is shown in its most preferred form as a gas spring 53. Gas spring 53 generally includes a piston slideably received in a cylinder. Gas spring 53 has one end suitably pivotally secured to body portion 12 and the opposite end suitably pivotally secured to handle 16. Particularly, in the preferred form, one end of gas spring 53 is threadably received in a grommet 55. Grommet 55 is slideably and rotatably received on axle 72. A U-shaped bracket 57 slideably receives handle 16 spaced from pivot pin 50 and is secured thereto by a connector pin 59. Bracket 57 includes first and second rearwardly extending ears 61 which are in a parallel, spaced relation. A pin 63 extends through and between ears 61 and a grommet threadably secured to or an ear formed on the other end of gas spring 53 and located intermediate ears 61. Thus, one end of gas spring 53 is pivotably secured to body portion 12 about the axis defined by axle 72 and the other end of gas spring 53 is pivotably secured to handle 16 about the axis defined by pin 63 which is spaced from and parallel to pin 50 and axle 72. Thus, gas spring 53 biases handle 16 in an upright position towards the front of body portion 12 of floor polishing machine 10.

Floor polishing machine 10 further includes a generally L-shaped component or latch 74 pivotally secured to body portion 12. Particularly, latch 74 includes a lever plate 75 having an upper end terminating in a cord hook 77 extending generally perpendicularly therefrom. The lower end of lever plate 75 includes an opening 79 extending therethrough for slideable and rotatable receipt on axle 72. An L-shaped slot 81 is formed in lever plate 75 adjacent its upper end and includes a first leg 83 of an elongated length extending in a direction generally radially to opening 79 and a second leg 85 extending generally perpendicular to and forward of the radially outer end of leg 83. Legs 83 and 85 are of size allowing slideable receipt of an end of pin 59.

It should be noted that when latch 74 is positioned relative to handle 16 such that pin 59 is within the length of leg 83, handle 16 is able to pivot relative to body portion 12 with pin 59 sliding within and at various positions along the length of leg 83 depending upon the angle of handle 16 relative to body portion 12. It should be appreciated that due to the operative connection between handle 16 and latch 74 provided by the positioning of pin 59 inside of leg 83, pivoting of handle 16 relative to body portion 12 about pin 50 causes pivoting of latch 74 relative to body portion 12 about axle 72. However, when latch 74 is positioned relative to handle 16 such that pin 59 is within leg 85 and outside of the length of leg 83, pin 59 will abut with the radially inner and outer edges of leg 85 when handle 16 is attempted to be pivoted relative to body portion 12 and thereby preventing handle 16 from pivoting with respect to body portion 12. In the preferred form, handle 16 extends from body portion 12 generally perpendicular to polishing member 14 when pin 59 is within leg 85 and is considered to be in an upright, transport position. Handle 16 extends from body portion 12 at an obtuse angle to polishing member 14 when pin 59 is within leg 83 and outside of the length of leg 85 and is considered to be in an operating position. In the preferred form, a detent can be formed inside of slot 81 at the junction of legs 83 and 85 of a size to tightly engage pin 59 to prevent latch 74 from inadvertently pivoting about axle 72 and moving pin 59 from one of legs 83 and 85 to the other. Specifically, latch 74 must be forced to pivot such as by kicking to move such that pin 59 changes position from within leg 85 to within leg 83 and/or from within leg 83 to within leg 85.

It can be appreciated that when pin 59 is located within leg 85 of slot 81, handle 16 is prevented from pivoting with respect to body portion 12 and is held in an upright, transport position generally perpendicular to polishing member 14. Thus, when handle 16 is latched in its upright position, floor polishing machine 10 may be tilted rearwardly until wheels 70 engage the floor surface and such that polishing member 14 is spaced from the floor. This permits floor polishing machine 10 according to the teachings of the present invention to be transported when not in use and also allows access to floor polishing member 14.

Now that the preferred construction of floor polishing machine 10 according to the teachings of the present invention has been set forth, the operation and subtle features of the present invention can be explained and appreciated. For the sake of explanation, it will be assumed that handle 16 is latched in its upright transport position by latch 74 in a pivotal position relative to handle 16 such that pin 59 is located in leg 85 of slot 81. It will be further assumed that floor polishing machine 10 has its electric cord 87 wrapped around cord hook 77 and one of the hand grips 89 of handle 16 which thereby functions as a second cord hook. Due to the relatively large mass of motor 24, when handle 16 is not supported by an operator, such as when it is in storage, floor polishing machine 10 will rest on wheels 68 and polishing member 14. Due to the pivotal mounting of polishing member 14 to platform 20, polishing member 14 will sit flat on the floor surface without giving a compression set to polishing member 14 which could occur if mounted directly to platform 20 such as in U.S. Pat. No. 4,658,459. However, to prevent deformation of polishing member 14 during long term storage, it is desirable to place a block under a portion of the front of floor polishing machine 10 such that polishing member 14 does not have weight thereon for long periods of time.

After floor polishing machine 10 has been transported to the floor location desired to be polished, the operator pushes latch 74 such as by his foot so that latch 74 pivots about axle 72 and relative to handle 16 such that pin 59 moves from leg 85 into leg 83 of slot 81 allowing handle 16 to be pivotal with respect to body portion 12 about pivot pin 50. It should be appreciated that since handle 16 and latch 74 are pivotable about spaced pivot axes defined by pin 50 and axle 72 and since axle 72 is located rearward of pin 50, the distance between cord hook 77 and handgrip 89 mounted on components which are operatively connected decreases as handle 16 pivots relative to body portion 12 away from its upright, transport position. Thus, the operator can insert his hand inside the looped electric cord 87 and remove it in its looped condition from cord hook 77 and handgrip 89. Once removed, the looped cord can be dropped or otherwise placed on the floor surface. The plug end of cord 87 can be grasped and pulled to the necessary length so that the plug can be plugged into an electrical outlet. It should be noted that cord 87 can be quickly removed and specifically that it is not necessary to unwrap cord 87 from floor polishing machine 10 as was necessary for most conventional floor polishing machines. It should also be appreciated that latch 74 performs two separate functions, namely for locking handle 16 in its upright, transport position and also for providing a releasable cord wrap mechanism, and thus reduces the number of components required and simplifying the overall design of floor polishing machine 10.

It can be appreciated that urging member 52 according to the teachings of the present invention biases handle 16 from an angular position with respect to body portion 12 and towards its upright position with respect to body portion 12. When handgrips 89 are grasped by the operator and handle 16 is lowered into its operating position, handle 16 creates a load on urging member 52. Specifically, since the spacings between pivot pin 50 and bracket 57 and between pivot pin 50 and axle 72 remain constant, the spacing between the ends of gas spring 53 decreases forcing the piston into the cylinder due to their connection to bracket 57 and axle 72. As the piston moves into the cylinder, the gas in the pressure chamber must be compressed due to the decreasing volume thereby resisting movement of the piston into the cylinder and biasing the piston out of the cylinder. Thus, when handle 16 is pivoted from its upright, transport position, gas spring 53 places a downward force to the rear of platform 20 and resisting relative movement of body portion 12 and handle 16. Wheels 68 function as pivot points so that the downward force to the rear of platform 20 effects an upward lift to the front of platform 20. Thus, urging member 52 acts essentially as a coupling device between handle 16 and platform 20 allowing a controlled amount of downward force from handle 16 to be transmitted to platform 20 of housing 18.

It should also be appreciated that without activation of motor 24 rotating polishing member 14 and with handle 16 in an operating position, body portion 12 will pivot about wheels 68 such that the forward portion of body portion 12 and of polishing member 14 is raised above the floor as the result of urging member 52. Specifically, since urging member 52 tends to bias handle 16 in its upright position, when handle 16 is held in its operating position which is out of the upright position, body portion 12 is then biased toward a generally perpendicular relationship with handle 16. Wheels 68 extend below polishing member 14 a sufficient distance such that polishing member 14 does not engage the floor surface when it is not rotating and when the front of platform 20 is being urged by member 52 with handle 16 in an operating position. It can be realized that wheels 70 limit movement of body portion 12 by abutting with the floor surface such that further tilting of body portion 12 about wheels 68 is prevented.

When motor 24 is activated rotating polishing member 14, the high speed of the rotating polishing member 14 forces the air from underneath the center of polishing member 14 causing a partial vacuum under polishing member 14. This partial vacuum creates a suction effect for drawing polishing member 14 to engage the floor surface and urging the forward portion of body portion 12 downward. This movement of the forward portion of body portion 12 downward is further enhanced in the most preferred form due to the positioning of motor 24 forward of wheels 68 such that the mass of motor 24 tends to pivot body portion 12 about wheels 68 under the force of gravity towards a level position.

During rotation of polishing member 14, the downward movement of the forward end of platform 20 of body portion 12 created by the suction effect and gravity is countered by the biasing force exerted by urging member 52 which tends to pull the forward end of body portion 12 upward. Furthermore, it can be appreciated that the front is urged upwardly by member 52 with substantially equal force regardless of the position of handle 16 due to the constant spring force exerted by urging member 52. Likewise, the downward movement force created by the suction effect and gravity is substantially constant for the same rotation speeds of polishing member 14. Therefore, it can be appreciated that a calculated balance can be created between the force of handle 16 to lift polishing member 14 through urging member 52 and the characteristic of polishing member 14 to pull itself down due to the suction effect created. Therefore, pressure placed on the floor surface by polishing member 14 is substantially constant regardless of the pivotal position of handle 16 with respect to platform 20 of housing 12. Thus, even though the pivotal position of handle 16 with respect to platform 12 should change due to the unevenness of the floor surface, due to use of polishing members 14 having differing thicknesses, due to the wear of polishing member 14, or due to holding the end of handle 16 at varying heights above the floor surface, the pressure that polishing member 14 places upon the floor surface is controlled automatically and without being dependent on operator involvement.

It can be appreciated that wheels 70 in the preferred form of floor polishing machine 10 according to the teachings of the present invention perform a dual function. First, they limit the amount of upward movement of the front of polishing member 14 under the bias of urging member 52 to insure that a partial vacuum is created when polishing member 14 is initially rotated to create the suction effect for pulling the front of polishing member 14 downward. Secondly, wheels 70 according to the teachings of the present invention serve as transport wheels when floor polishing machine 10 is being moved between locations.

It can further be appreciated that the pivotal mounting of motor 24 and thus of polishing member 14 to body portion 12 according to the teachings of the present invention is also advantageous. Specifically, the pivotal mounting of polishing member 14 allows polishing member 14 to pivot out of the plane of housing 18 to match the plane of the floor surface being polished. Thus, the suction effect draws polishing member 14 to flushly engage the floor surface around its entire circumference independent of the position of housing 18 relative to the floor surface. In prior handle type floor polishing machines, polishing member 14 always matched the plane of housing 18 and was supported by operating wheels 68 to be at an angle to the floor surface with generally the front portions of polishing member 14 engaging the floor surface while the rear portions of polishing member 14 either not engaging or engaging with minimal pressure. It should then be appreciated that such prior approaches did not utilize the entire circumference of polishing member 14 and thus did not have a full polishing pattern but rather only utilized approximately the front two-thirds of polishing member 14 or less. Other prior approaches such as disclosed in U.S. Pat. No. 4,845,798 required wheel adjustment as the pad or similar polishing member wore. Additionally, the engagement force was not consistent throughout the area of polishing member 14 which did engage the floor. Furthermore, the area and force of engagement of polishing member 14 depended on the thickness of polishing member 14 and also changed if the floor surface was uneven. It should then be appreciated that since polishing member 14 is able to pivot to match the floor surface, polishing member 14 utilizes the area around its entire circumference and that engagement forces are generally consistent throughout the entire engagement area independent of the thickness of polishing member 14. Thus, any particular area of the floor surface will be subjected to more polishing action with floor polishing machine 10 according to the teachings of the present invention. Additionally, better polishing and a more consistent shine of uneven floor surfaces can be obtained as floor polishing member 14 according to the teachings of the present invention is able to better follow the contour of the floor surface.

It should be appreciated that urging member 52 in its most preferred form of a gas spring is particularly advantageous. Specifically, gas spring 53 achieves its working load immediately and specifically does not require preloading. Particularly, when urging member 52 in the form of a torsion spring was utilized as set forth in U.S. Pat. No. 4,658,459, it was necessary to preload the tension spring. Due to the difficulty of and potential injury from assembly, floor polishing machine 10 of U.S. Pat. No. 4,658,459 was sold with handle 16 factory assembled on body portion 12 and thus increasing the overall size for packaging and handling. According to the teachings of the present invention, floor polishing machine 10 can be sold with handle 16 and gas spring 53 disassembled from body portion 12. Assembly can then be performed by simply inserting pin 50 through body portion 12 and handle 16 and by threading gas spring 53 into grommet 55. The biasing force provided by gas spring 53 can be easily modified by changing the distance between pins 50 and 63 and/or by adjusting the amount that gas spring 53 is rotated into grommet 55. It can then be appreciated that there is little risk of floor polishing machine 10 according to the teachings of the present invention flying apart during assembly, servicing, or replacement of gas spring 53 which could be a problem when urging means 52 in the form of a tension spring was utilized. Additionally, when urging member 52 in the form of a torsion spring was utilized as set forth in U.S. Pat. No. 4,658,459, the free ends of the torsion spring exert a high compression force on platform 20. Some materials such as rotationally molded plastic would not hold up under such a high compression force without some type of reinforcement. As gas spring 53 of the preferred form spreads the load over the length of axle 72, platform 20 can be formed of plastic or like materials. Further, gas spring 53 provides a fairly constant spring force at all times as compared to compression, extension, or torsion springs. Thus, gas spring 53 pulls the forward end of platform 22 upward with substantially equal force regardless of the position of handle 16 and without variable force compensation such as by complicated lever arm connections. Additionally, gas spring 53 has a natural dampening effect which helps to even out the amperage for motor 24 and reduces current spikes as machine 10 is moved over uneven floors. Thus, the construction of floor polishing machine 10 according to the teachings of the present invention utilizing gas spring 53 is advantageous.

Now that the basic teachings of the present invention have been explained, many extensions and variations will be obvious to one having ordinary skill in the art. For example, body portion 12 may take other forms and constructions while utilizing the teachings of the present invention than the preferred form and construction as shown and described. As an example, housing 18 and the mounting of wheels 68 and 70 can have other shapes, forms, and constructions while obtaining the advantages of the present invention.

Although floor polishing machine 10 in the most preferred form includes several unique features and is believed to produce synergistic results, a floor polishing machine 10 could be constructed according to the teachings of the present invention utilizing such features individually or in other combinations. As an example, a floor polishing machine 10 utilizing the latching construction of U.S. Pat. No. 4,658,459 in place of latch 74 could be constructed according to the teachings of the present invention with the features of gas spring 53 and the pivotal polishing member 14.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

We claim:

1. Machine for polishing floor surfaces comprising, in combination: a platform having a front and a rear; a first set of wheels rotatably mounted to the platform along a generally horizontal wheel axis adjacent the rear of the platform, with the wheels movably supporting the platform on the floor surface, with the platform being pivotal relative to the floor about the wheel axis; a polishing member for rotation about a generally vertical axis and means for rotating the polishing member about the vertical axis; means for pivotally mounting the polishing member to the platform about a pivot axis spaced from and parallel to the wheel axis, with the polishing member being rotatable about the vertical axis relative to the platform, with the pivotable mounting of the polishing member to the platform allowing the polishing member to flushly abut the floor surface; a first component pivotally mounted to the platform about a generally horizontal pivot axis; a gas spring having a first end pivotally connected to the first component about an axis spaced from the pivot axis and having a second end pivotally connected to the platform about an axis spaced from the pivot axis, with the gas spring biasing the platform to pivot relative to the first component to raise the floor polishing member off the floor, with the floor polishing member being spaced from the floor when the polishing member is not being rotated by the rotating means allowing a partial vacuum to be formed under the polishing member when the polishing member is initially rotated by the rotating means to place a downward suction on the polishing member and counteracting with the gas spring to place an even force on the floor surface by the polishing member regardless of the pivotal position of the first component with respect to the platform and regardless of the unevenness of the floor surface; a second component pivotally mounted to the platform about a pivot axis; a first cord hook formed on the second component, with the first component pivotally mounted to the platform about the horizontal pivot axis spaced from and parallel to the pivot axis of the second component; a second cord hook formed on the first component, with the first and second cord hooks receiving the electric cord wrapped therebetween; and means for operatively connecting the first component to the second component so that pivoting of the first component relative to the platform causes pivoting of the second component relative to the platform, with the first and second components being pivotal relative to the platform from a storage position to a release position with the distance between the first and second cord hooks decreasing as the first and second components pivot from the storage position to the release position.

2. Mechanism for an elongated electric cord comprising, in combination: a first component; a second component pivotally mounted to the first component about a first pivot axis; a first cord hook formed on the second component; a third component pivotally mounted to the first component about a second pivot axis spaced from and parallel to the first pivot axis; a second cord hook formed on the third component, with the first and second cord hooks receiving the electric cord wrapped therebetween; and means for operatively connecting the third component to the second component so that pivoting of the second component relative to the first component causes pivoting of the third component relative to the first component, with the second and third components being pivotal relative to the first component from a storage position to a release position with the distance between the first and second cord hooks decreasing as the second and third components pivot from the storage position to the release position.

3. The mechanism of claim 2 wherein the operatively connecting means comprises, in combination: an elongated slot formed in the third component; and a pin extending from the second component and slideably received in the slot.

4. The mechanism of claim 2 wherein the operatively connecting means includes means for latching the second and third components in the storage position.

5. The mechanism of claim 4 wherein the operatively connecting means comprises, in combination: an elongated slot formed in the third component; and a pin extending from the second component and slideably received in the slot, with the slot being L-shaped and having a first leg and a second leg, with the pin received in the first leg preventing relative movement between the second and third components in the storage position and received in the second leg allowing relative movement between the second and third components.

6. The mechanism of claim 5 wherein the second component comprises a handle; and wherein the first cord hook comprises a handgrip formed on the handle.

7. Machine for polishing floor surfaces comprising, in combination: a platform having a front and a rear; a polishing member rotatably mounted to the platform for rotation about a generally vertical axis and means for rotating the polishing member about the vertical axis; a transport component pivotally mounted to the platform about a generally horizontal pivot axis; a gas spring having a first end pivotally connected to the transport component about an axis spaced from the pivot axis and having a second end pivotally connected to the platform about an axis spaced from the pivot axis, with the gas spring biasing the platform to pivot relative to the transport component to raise the floor polishing member off the floor, with the floor polishing member being spaced from the floor when the polishing member is not being rotated by the rotating means allowing a partial vacuum to be formed under the polishing member when the polishing member is initially rotated by the rotating means to place a downward suction on the polishing member and counteracting with the gas spring to place an even force on the floor surface by the polishing member regardless of the pivotal position of the transport component with respect to the platform and regardless of the unevenness of the floor surface; and means for movably supporting the platform relative to the floor surface.

8. The floor polishing machine of claim 7 wherein the movably supporting means is mounted to the platform and comprises a first set of wheels rotatably mounted along a generally horizontal wheel axis adjacent the rear of the platform for supporting the platform above the floor surface, with the pivot axis of the transport component located on the opposite side of the wheel axis than the vertical axis of the polishing member, with the gas spring pivoting the platform about the wheel axis of the first set of wheels with the rear of the platform being biased in a downward direction and the front of the platform being biased in an upward direction; and means located at the rear of the platform and on the opposite side of the wheel axis than the vertical axis of the polishing member for limiting the amount of upward movement of the front of the platform by the gas spring; and wherein the transport component is a handle.

9. The floor polishing machine of claim 8 wherein the first set of wheels space the rear of the platform from the floor surface.

10. The floor polishing machine of claim 9 wherein when the gas spring pivots the platform about the wheel axis of the first set of wheels, the first set of wheels spaces the entire polishing member from the floor surface when the polishing member is not being rotated by the rotating means.

11. The floor polishing machine of claim 8 wherein the handle is pivotally mounted to the platform between operating positions and a transport position; and wherein the limiting means also enables the transport of the platform and polishing member over the floor surface when the handle is in the transport position.

12. The floor polishing machine of claim 11 wherein the limiting means comprises a second set of wheels extending at a level slightly above the level of the first set of wheels, with the second set of wheels being rotatably mounted to the platform along a generally horizontal wheel axis coincident with the axis of the second end of the gas spring.

13. The floor polishing machine of claim 12 wherein the level of the second set of wheels is in the range of ⅛ to ¼ inches (0.3 to 0.6 cm) above the level of the first set of wheels.

14. The floor polishing machine of claim 12 further comprising, in combination: means for locking the handle in its transport position comprising, in combination: a latch pivotally mounted to the platform about an axis coincident with the axis of the second end of the gas spring, with the lever having an L-shaped slot having a first leg and a second leg; and a pin extending from the handle and slideably received in the slot, with the pin received in the first leg preventing movement of the handle and the latch relative to the platform and received in the second leg allowing movement of the handle and the latch relative to the platform.

15. The floor polishing machine of claim 14 wherein the handle includes a handgrip; and wherein the latch further includes a cord hook, with the distance between the handgrip and the cord hook decreasing as the pin slides in the second leg away from the first leg.

16. The floor polishing machine of claim 8 wherein the polishing member is pivotally mounted to the platform about a pivot axis spaced from and parallel to the wheel axis.

17. Machine for polishing floor surfaces comprising, in combination: a platform having a front and a rear; a first set of wheels rotatably mounted to the platform along a generally horizontal wheel axis adjacent the rear of the platform, with the wheels movably supporting the platform on the floor surface, with the platform being pivotal relative to the floor about the wheel axis; a polishing member for rotation about a generally vertical axis and means for rotating the polishing member about the vertical axis; and means for pivotally mounting the polishing member to the platform about a pivot axis spaced from and parallel to the wheel axis, with the polishing member being rotatable about the vertical axis relative to the platform, with the pivotable mounting of the polishing member to the platform allowing the polishing member to flushly abut the floor surface.

18. The floor polishing machine of claim 17 wherein the platform is annular shaped and includes a central opening; and wherein the pivotally mounting means comprises, in combination: a mounting plate received in the central opening and having radially extending ears on opposite diametric sides; and means for rotatably securing the ears to the platform about the pivot axis.

* * * * *